US007658210B1

(12) United States Patent
Nyce

(10) Patent No.: US 7,658,210 B1
(45) Date of Patent: Feb. 9, 2010

(54) LOOM

(76) Inventor: Kristen Nyce, 13943 Winding Ridge La., Centreville, VA (US) 20121

( * ) Notice: Subject to any disclaimer, the term of this patent is extended or adjusted under 35 U.S.C. 154(b) by 0 days.

(21) Appl. No.: 12/285,768

(22) Filed: Oct. 14, 2008

(51) Int. Cl.
*D03D 29/00* (2006.01)
*D03D 33/00* (2006.01)
*D03D 41/00* (2006.01)

(52) U.S. Cl. ..... 139/29; 139/11; 139/30; 139/33; 139/34

(58) Field of Classification Search ..... 139/11, 139/29, 30, 33, 34
See application file for complete search history.

(56) References Cited

U.S. PATENT DOCUMENTS

| | | | | | |
|---|---|---|---|---|---|
| 229,732 | A * | 7/1880 | Miller | 139/28 |
| 234,761 | A * | 11/1880 | Fish | 139/33 |
| 392,859 | A * | 11/1888 | Fichtner | 139/33 |
| 2,094,505 | A * | 9/1937 | Thackeray | 139/33 |
| 2,147,483 | A * | 2/1939 | Churchill | 139/29 |
| 2,150,187 | A * | 3/1939 | Raba et al. | 139/33 |
| 2,277,119 | A * | 3/1942 | Lichtner | 139/33 |
| 2,502,691 | A * | 4/1950 | Allan et al. | 139/33 |
| 3,885,597 | A * | 5/1975 | Hines | 139/29 |
| 4,023,245 | A * | 5/1977 | Zaltzman | 28/152 |
| 4,109,685 | A * | 8/1978 | Westin | 139/33 |
| 4,160,467 | A * | 7/1979 | Woodruff | 139/33 |
| 4,314,576 | A * | 2/1982 | McGee | 135/67 |
| 4,462,432 | A * | 7/1984 | Sajo et al. | 139/33 |
| 4,608,969 | A * | 9/1986 | Hamlin | 606/243 |
| 6,368,295 | B1 * | 4/2002 | Lerman | 602/17 |

OTHER PUBLICATIONS

Eric Broudy, The Book of Looms: A History of the Handloom From Ancient Times to the Present (1993), front cover, inner cover, citation information, and pp. 89 and 91 (5 pages total).

Ashford Wheels & Looms, Ashford Knitters Loom Product Description, *available at* http://www.ashford.co.nz/weaving/knitters_loom.htm (last visited Nov. 18, 2008) (3 pages).

Shacht Spindle Co., Inc., Rigid Heddle Loom Assembly and Weaving Instructions, *available at* http://www.schachtspindle.com/instructions/weaving/rigid%20heddle%20loom.htm (last visited Nov. 18, 2008) (9 pages).

* cited by examiner

*Primary Examiner*—Bobby H Muromoto, Jr.
(74) *Attorney, Agent, or Firm*—Finnegan, Henderson, Farabow, Garrett and Dunner, L.L.P.

(57) ABSTRACT

A loom and method of weaving, the loom having a frame and a member rotatably mounted on the frame. The rotatable member including a chin bar and a heddle. The loom is mountable on an operator's shoulders so that the operator may apply a force to the chin bar of the rotatable member, moving the heddle. Also a tandem loom having a frame supporting two rotatable members, for manipulating the two heddles by multiple operators.

20 Claims, 9 Drawing Sheets

LOOM

TECHNICAL FIELD

This disclosure generally relates to a loom and a method of operating a loom. Specifically, this disclosure relates to a portable loom that may be driven by an operator's chin.

BACKGROUND

In a loom, it is required to selectively raise and lower the warp threads so that the weft thread may be passed through the shed. A shuttle may facilitate passing the weft through the shed.

Typical looms provide shafts or harnesses, containing one or more heddles, that facilitate selectively raising and lowering the warp.

One example of a type of loom is a table loom. The table loom is generally placed on a table or stand. An operator manually moves the shafts or harnesses to manipulate the warp. This type of loom is not portable during operation. Additionally, because an operator must use her hands to move the shafts or harnesses, she must drop the shuttle periodically whenever the shafts or harnesses must be moved.

Another type of loom is a floor loom. A floor loom rests on a stand, and includes foot pedals called treadles. The treadles operatively connect to the shafts or harnesses. By manipulating the treadles, an operator may move the shafts or harnesses, thus creating a shed through which a weft may be passed. A floor loom frees up an operator's hands, so that she may continue to move the shuttle through the warp and need not drop the shuttle in order to manipulate the shafts or harnesses. This type of loom still presents the disadvantage, however, that it is not portable during operation. Additionally, the floor loom may be unsuitable for an operator who lacks full use of his or her legs or feet.

Other types of looms include power looms (whose shafts or harnesses are manipulated by machine), frame looms, and back strap looms. None of these looms are portable during operation. The looms may also require complex parts and mechanisms for their operation, which can lead to significant expense.

In light of the foregoing, there is a need for a loom that is inexpensive, portable during operation, and frees an operator's hands from having to manipulate the shafts or harnesses. Additionally, there is a need for a method of operating a portable loom, whereby an operator is able to transport the loom during operation.

SUMMARY

To attain one or more of the above or other advantages, as embodied and broadly described herein, the disclosure is directed to a loom that includes a frame configured to hold a warp, and a shoulder support mounted on the frame. The shoulder support is configured to support the loom on the shoulders of an operator. The loom also includes a rotatable member mounted on the frame, with the rotatable member including a chin bar. The rotatable member is configured to rotate in response to a force applied to the chin bar by the chin of an operator. Rotation of the rotatable member is configured to create a shed in the warp.

The disclosure is further directed to a tandem loom comprising a frame having a first end and a second end, with the frame configured to hold a first warp and a second warp. A first shoulder support is attachable to the first end of the frame and configured to be mounted on the shoulders of a first operator. A second shoulder support is attachable to the second end of the frame and configured to be mounted on the shoulders of a second operator. A first rotatable member is attached to the first end of the frame by a first axle, with the first rotatable member including a first chin bar and a first heddle. A second rotatable member is attached to the second end of the frame by a second axle, with the second rotatable member including a second chin bar and a second heddle. The first rotatable member is configured to translate a force on the first chin bar from the chin of the first operator into a force on the first heddle, causing the first heddle to create a shed in the first warp. The second rotatable member is configured to translate a force on the second chin bar from the chin of the second operator into a force on the second heddle, causing the second heddle to create a shed in the second warp.

The disclosure is yet further directed to a method of weaving with a loom. A loom is provided including a frame having a warp beam and a cloth beam. The loom also includes a shoulder support mounted on the frame, the shoulder support configured to engage the shoulders of an operator. The loom further includes a rotatable member mounted on the frame, the rotatable member including a chin bar and a heddle. The method further includes winding a warp between the warp beam and the cloth beam, with the warp being threaded through the heddle. The frame is mounted onto the shoulders of an operator. The method also includes applying a force to the chin bar with the chin of an operator and creating a shed in the warp.

BRIEF DESCRIPTION OF THE DRAWINGS

The accompanying drawings, which are incorporated in and constitute a part of this specification, illustrate several embodiments and together with the description, serve to explain the aspects of the disclosure.

DESCRIPTION OF THE EMBODIMENTS

Embodiments of the invention are now described with reference to the accompanying drawings. Wherever possible, the same reference numbers appear throughout the drawings to refer to the same or like parts. An exemplary embodiment of a loom in accordance with the present disclosure is shown in FIGS. 1-5.

Figure 1:
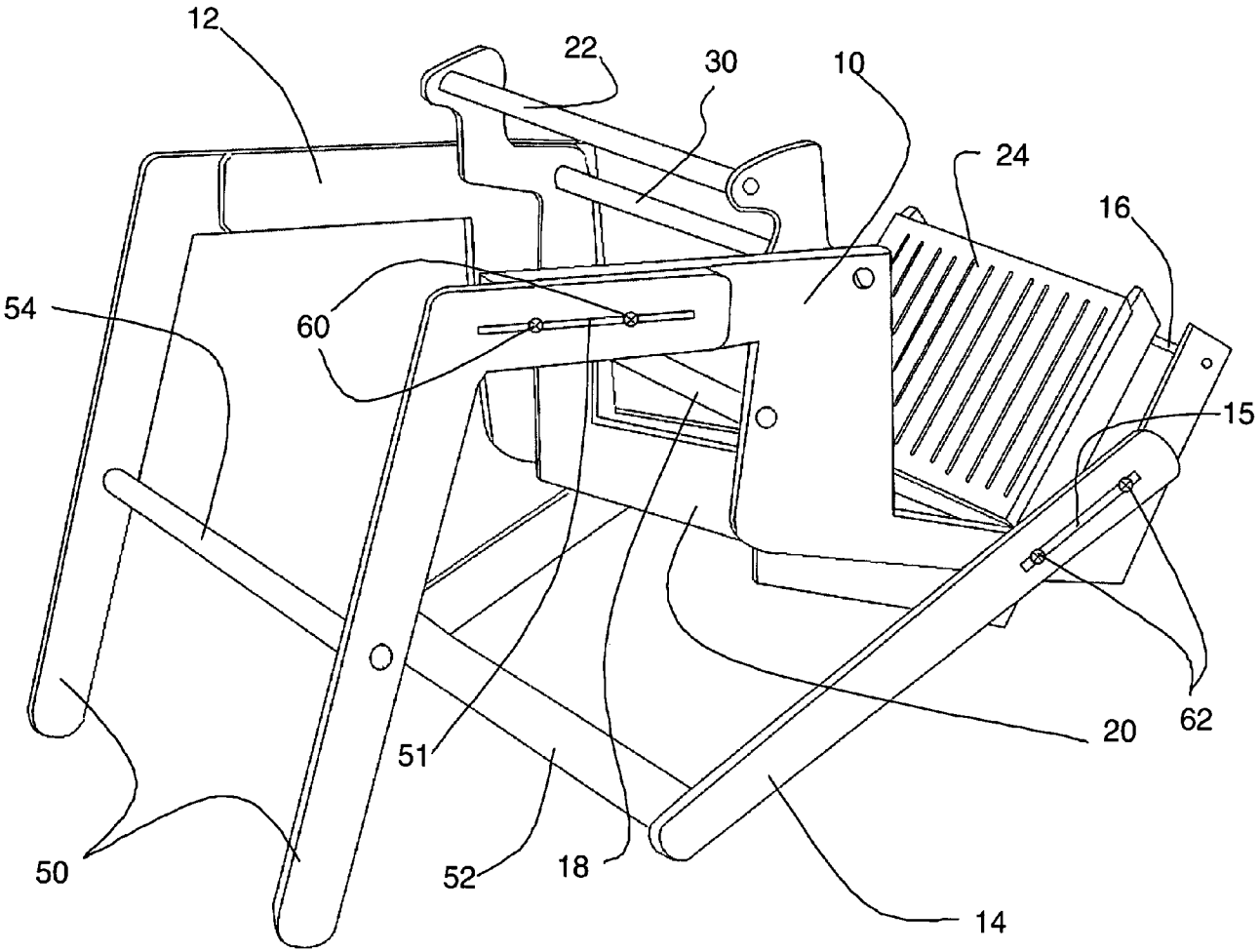
FIG. 1 is a perspective drawing illustrating an embodiment of a loom as set forth in the disclosure.

According to the embodiment of FIGS. 1-5, a loom may include a frame 10, an upper support 12, and a lower support 14. Additional support may be provided in the form of support arms 50 attached to the upper support 12, and a support beam 52 attached to the lower support 14. The support arms 50 may be connected to each other by a stabilizer 54. The loom may also include a warp beam 16 and a cloth beam 18, which may be mounted on the frame 10 as shown in FIG. 1. A rotatable member 20 may also be provided. The rotatable member 20 may include a bar 22 and a heddle 24. The heddle 24, best shown in FIG. 2, defines series of slots 26 and holes 28.

Figure 3A:
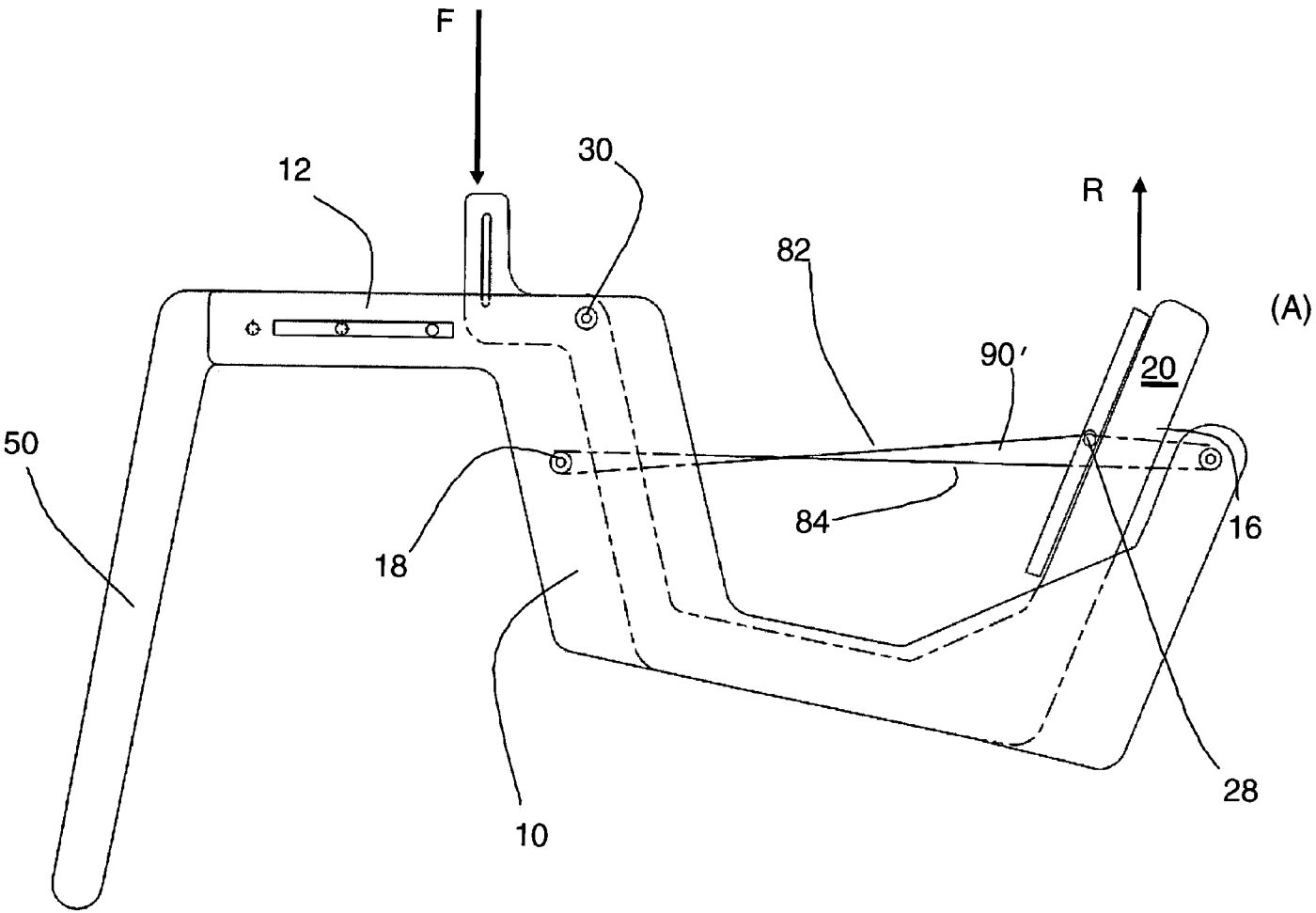
FIGS. 3A-3C are diagrammatic drawings illustrating first and second positions of the rotatable member of FIG. 1, and the application of forces F and F' to the rotatable member of FIG. 1.
Figure 3B:
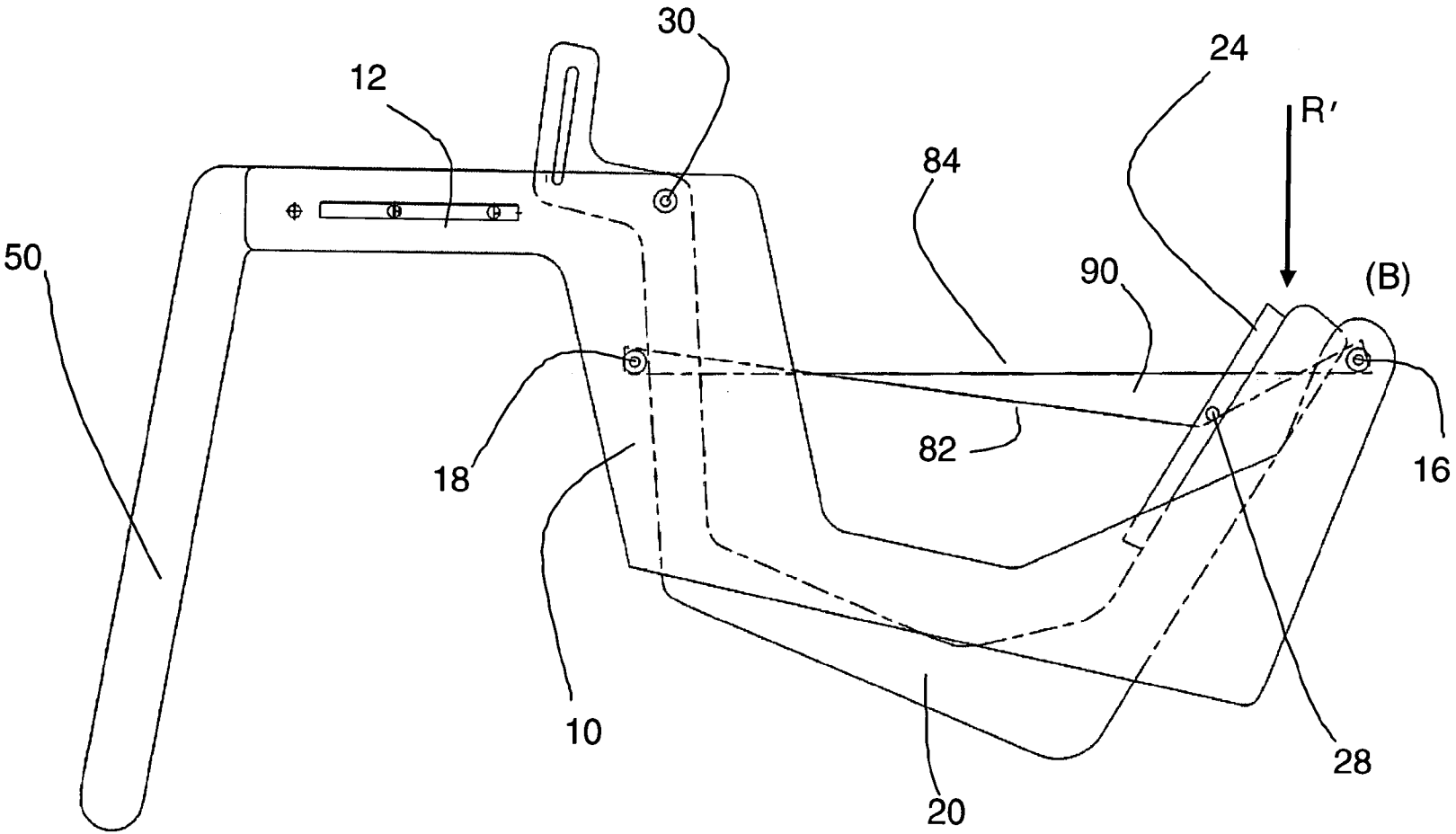
Figure 3C:
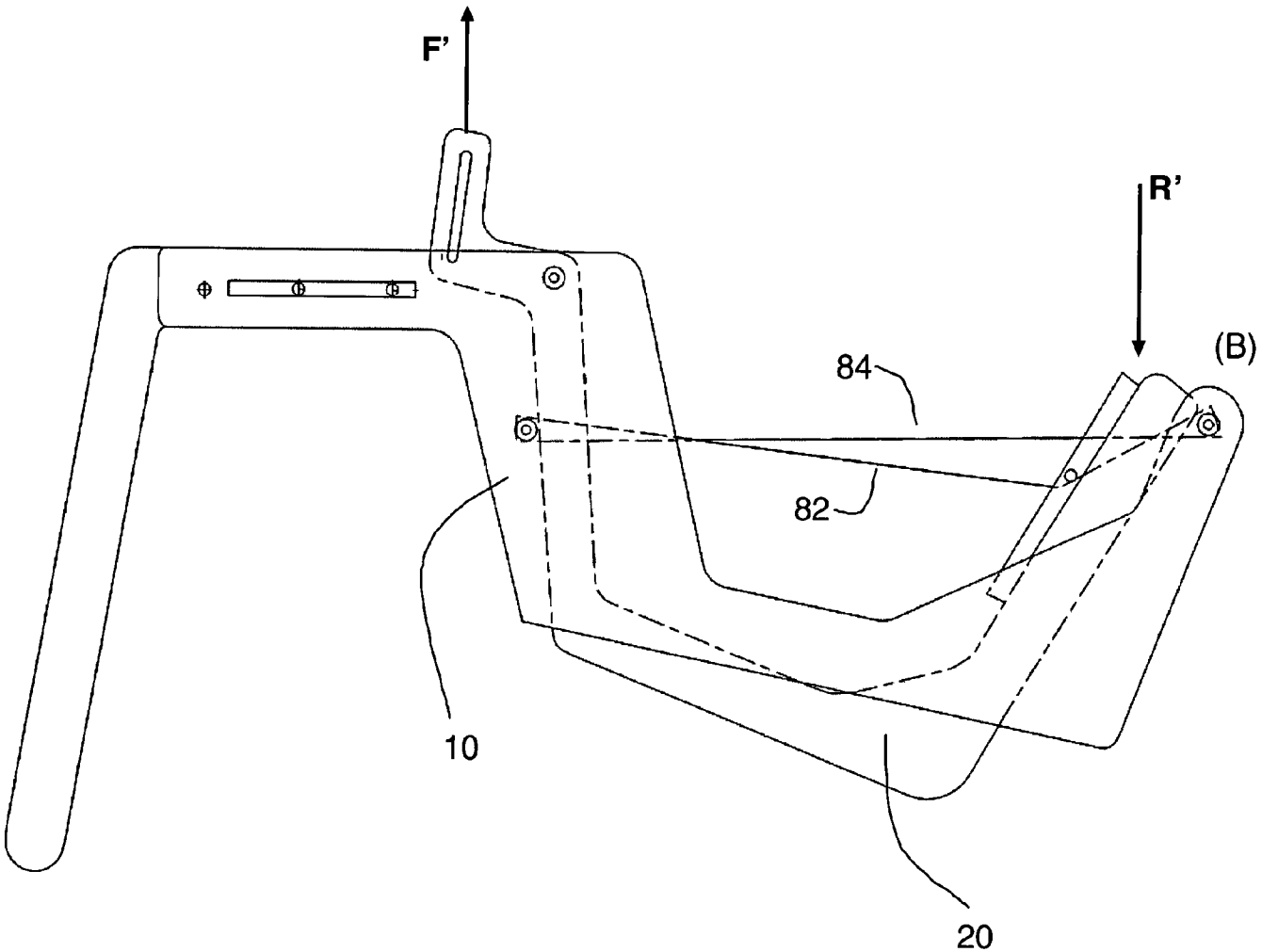

In the embodiment shown in FIG. 1, the rotatable member 20 attaches to the frame 10 by way of an axle 30. According to this embodiment, the rotatable member 20 is configured to pivot around the axle 30 upon the application of force to the bar 22 in the direction of arrow F, as shown in FIG. 3A. When the rotatable member 20 pivots under the application of this force, the heddle 24 correspondingly moves up in direction R into position A. Once the force F has been removed, the heddle 24 returns in direction R' to position B, as shown in FIG. 3B. According to the embodiment of FIG. 3B, the heddle 24 returns to position B due to gravity. It is also contemplated that the heddle 24 may return to position B due to a coil, spring, elastic band, or any other suitable device. It is further contemplated that the loom may be configured so that a force F' is required to return the heddle 24 to position B, as shown in FIG. 3C.

Figure 2:
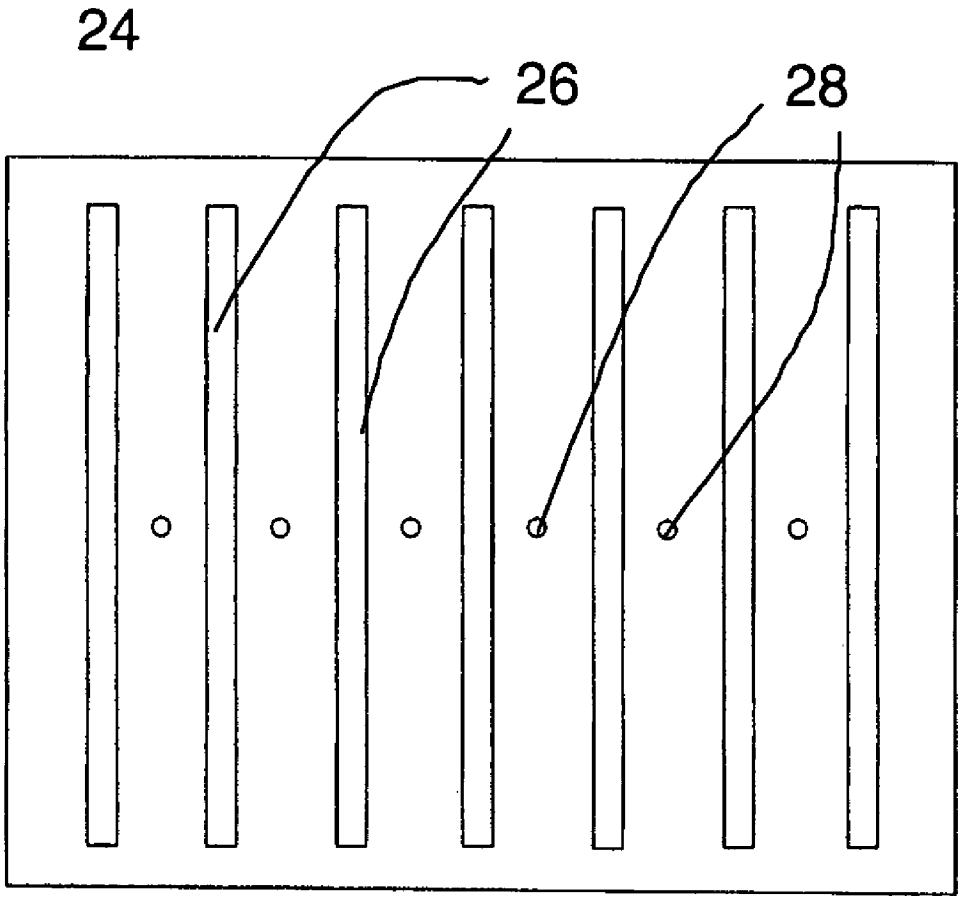
FIG. 2 is a diagrammatic drawing of a heddle for use in the embodiment of FIG. 1.
Figure 4:
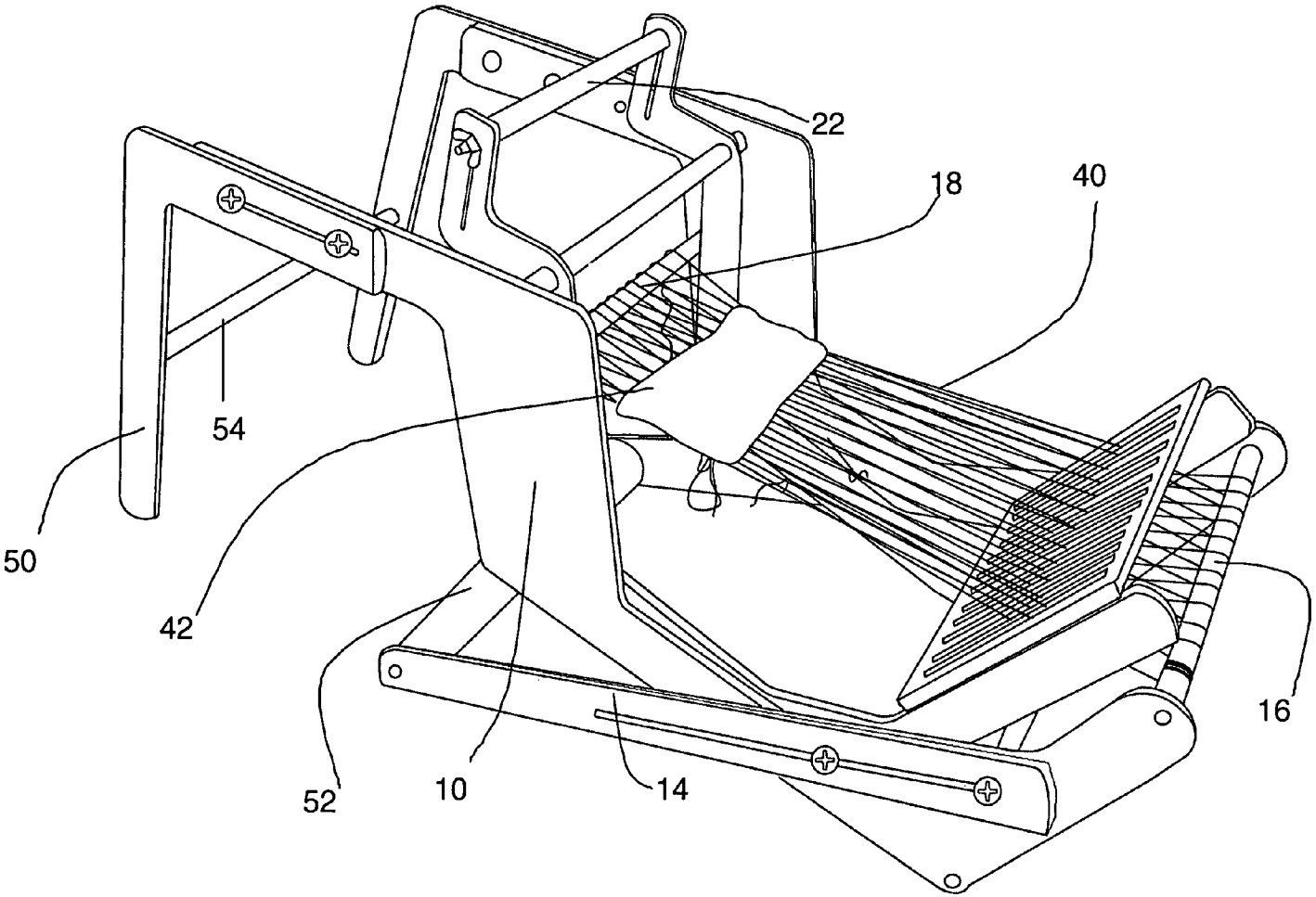
FIG. 4 is a perspective drawing of the embodiment of FIG. 1, including a warp and a weft.

In operation, the loom may be provided with a warp 40 and a weft 42, as shown in FIG. 4. The warp 40 is strung between the warp beam 16 and the cloth beam 18 as is well known in the art, with segments of the warp 40 passing alternately through the slots 26 and holes 28 defined by the heddle 24. As shown in FIGS. 3A and 3B, a first portion 82 of the warp passes through the holes 28, while a second portion 84 of the warp passes through the slots 26. Depending on the desired fineness of cloth, an operator may select different heddles 24 defining more or fewer slots 26 and holes 28. The heddle 24 of FIG. 2 is exemplary only. The present disclosure contemplates a heddle 24 defining any number of slots 26 and/or holes 28. Additionally, the heddle 24 of the present disclosure may be integrated with the rotatable member 20, or may be removable/replaceable. In an embodiment in which the heddle 24 may be removable or replaceable, it is contemplated that the heddle 24 may attach to the rotatable member 20 by a hook-and-loop fastener, latch, or any other suitable attachment mechanism.

To weave cloth, an operator may pass a weft 42 (with or without a shuttle, not shown) through the warp 40 in a first direction (into the page) when the heddle 24 is in position B (FIG. 3B). With the heddle in position B, the first portion 82 of the warp is positioned below the second portion 84 of the warp, creating a shed 90 between the first portion 82 and second portion 84 of the warp. The weft 42 may thus be passed through the shed 90, which is shown in FIG. 3B. An operator may then provide a force F to the bar 22, thereby moving the heddle 24 to position A (FIG. 3A) so that the first portion 82 of the warp is positioned above the second portion 84 of the warp, creating a shed 90'. The weft 42 may be passed back through the shed 90' in a second direction (out of the page). By removing force F from the bar 22, the heddle 24 returns to position B, and the weaving process may be repeated as many times as may be suitable or desired. After the operator has finished weaving, the warp 40 and weft 42, together forming a cloth, may be detached from the warp beam 16 and cloth beam 18 and the resulting cloth removed from the loom.

Figure 5:
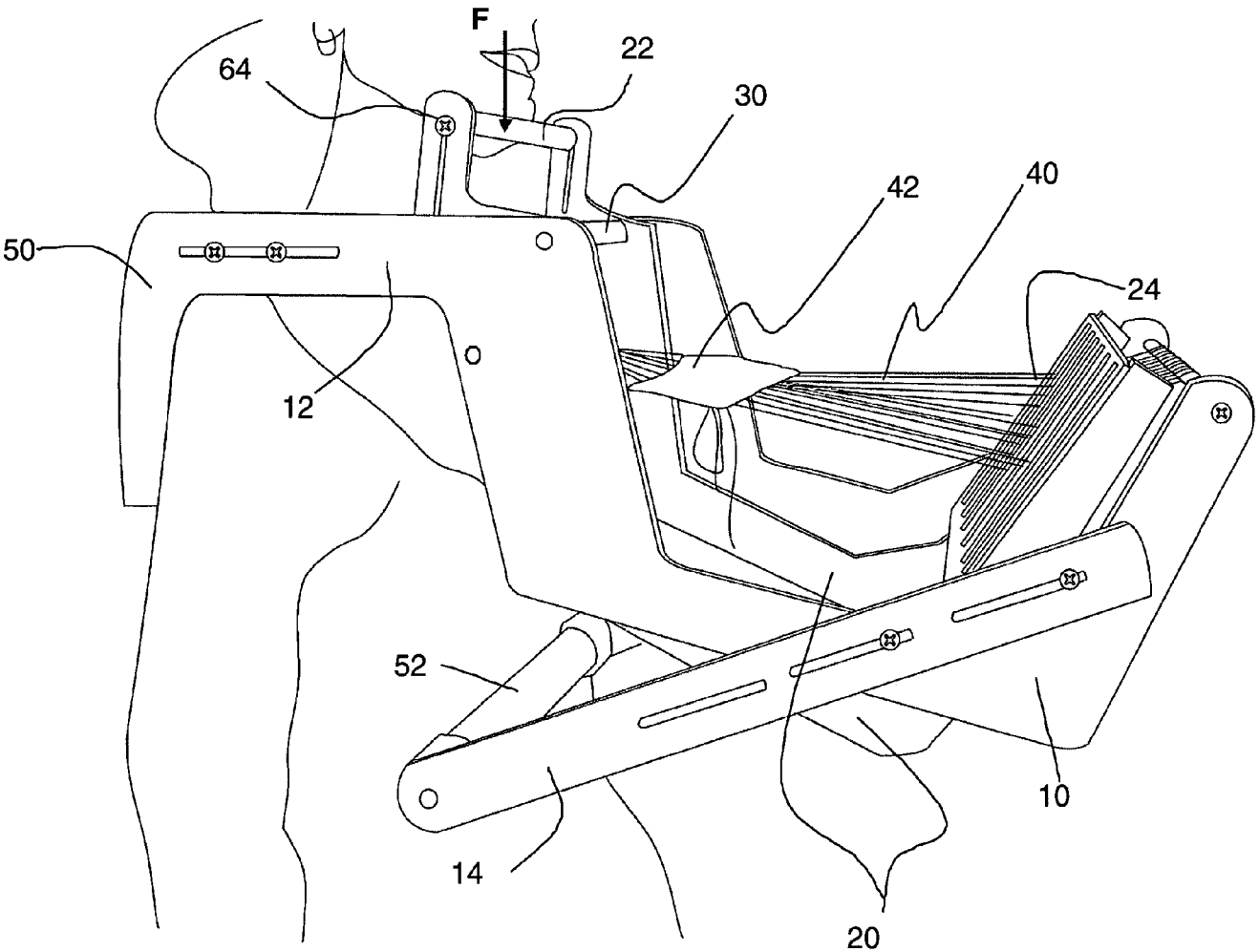
FIG. 5 is a perspective drawing of the embodiment of FIG. 1 mounted on an operator's shoulders.

As illustrated in FIG. 5, the loom may be designed to fit over the shoulders of an operator. As shown in FIG. 5, the support arms 50 may be shoulder supports 50, which are designed to fit over or around an operator's shoulders. Additionally, the support beam 52 may be a body support 52 as shown in FIG. 5. The body support 52 may be designed to rest against an operator's body.

Also as illustrated in FIG. 5, the loom may be designed for operation under a force F provided by an operator's chin. In this configuration, the bar 22 may be a chin bar 22 as shown in FIG. 5. With the loom in place on the shoulders and body of the operator, the operator may provide force F to the chin bar 22 by lowering her chin. Thus, an operator may move the heddle 24 up or down by moving her chin down or up. By operating the loom in conjunction with the warp 40 and the weft 42, the loom may be used for weaving.

It may be desirable for the loom to be adjusted to fit the body of the operator. Accordingly, the support arms 50 may be adjustably attached to the frame 10 via fasteners 60, such as wing nuts or screws. As shown in FIG. 1, support arms 50 may define slots 51 designed to slide adjustably relative to fasteners 60. Once support arms 50 have been desirably adjusted, fasteners 60 may be tightened to prevent the support arms 50 from moving further. Additional adjustments may be provided in an embodiment wherein lower support 14 adjustably attaches to the frame 10. As shown in FIG. 1, the lower support 14 may define slots 15 that allow lower support 14 to slide relative to fasteners 62, such as wing nuts or screws, and frame 10. The fasteners 62 may be tightened to secure lower support 14 into a desirable position. Yet further adjustments may be provided in an embodiment wherein the chin bar 22 is slidably attached to the rotatable member 20, secured by fasteners 64, such as wing nuts or screws, as shown in FIG. 5. While sliding adjustments have been described, the present disclosure contemplates additional adjustments, including adjustments wherein one or more components may be rotatably adjusted relative to another component. For example, the lower support 14 may adjustably rotate relative to the frame 10.

Figure 6:
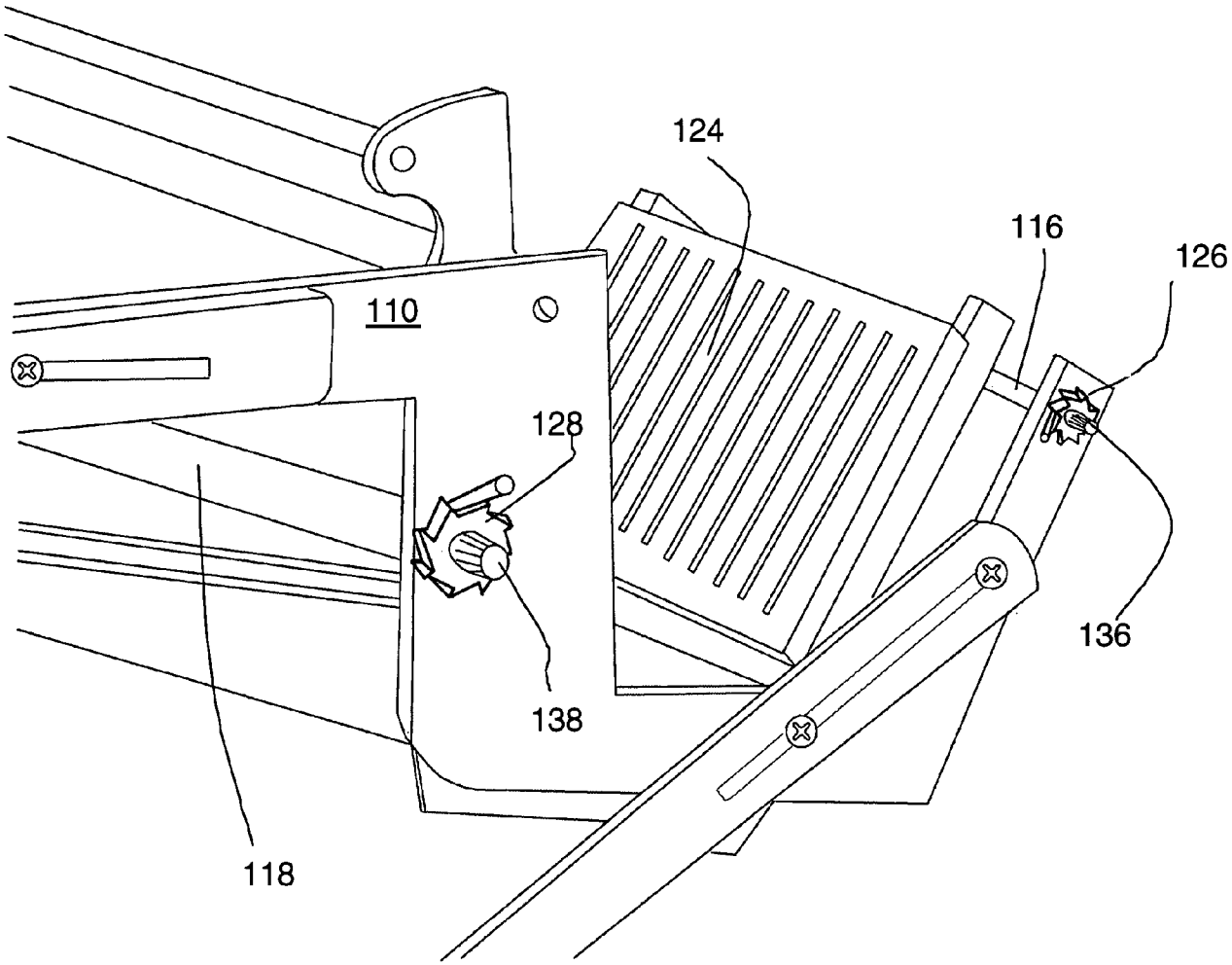
FIG. 6 is a perspective detail view of another embodiment of a loom in accordance with the disclosure, the embodiment having a ratchet system.

FIG. 6 shows another embodiment of a loom according to the present disclosure, which may provide the feature of a cloth roller 118 mounted on a frame 110. The cloth roller 118 may be provided with pins (not shown) and/or a clamp (not shown) that may secure a warp to the cloth roller 118. With the warp so secured, the cloth roller 118 may be rotated, thereby pulling or advancing the warp and causing the warp and cloth to wrap around the cloth roller 118. In one embodiment, the cloth roller 118 may be rotated through the use of a handle 138. By manipulating the cloth roller 118, an operator may adjust the slack of the warp, or may draw more warp toward the cloth roller 118 so that a longer cloth may be weaved. According to the embodiment shown in FIG. 6, the cloth roller 118 is provided with a ratchet 128 that prevents the warp and/or cloth from unrolling from the cloth roller 118. The present disclosure also contemplates cloth rollers 118 provided with a different mechanism that may prevent unrolling, such as a securing pin, wing nut, or any suitable locking mechanism.

The loom may also provide the feature of a warp roller 116, as also shown in FIG. 6. A warp roller 116 allows the loom to carry additional warp wrapped around the warp roller 116. Thus, once an operator has weaved a suitable amount of cloth, additional warp may be unrolled from the warp roller 116 and drawn or advanced into the weaving area between the warp roller 116 and cloth roller 118, so that additional cloth may be weaved. Additionally, an operator may adjust the slack of the warp by manipulating the warp roller 116. The warp roller may be manipulated, in the illustrated embodiment, by using a handle 136. As illustrated in FIG. 6, the warp roller 116 may include a ratchet 126 that prevents the warp from unrolling from the warp roller 116. The present embodiment also contemplates using any other suitable device for preventing the warp from unrolling from the warp roller 116, as is well known in the art.

Figure 7:
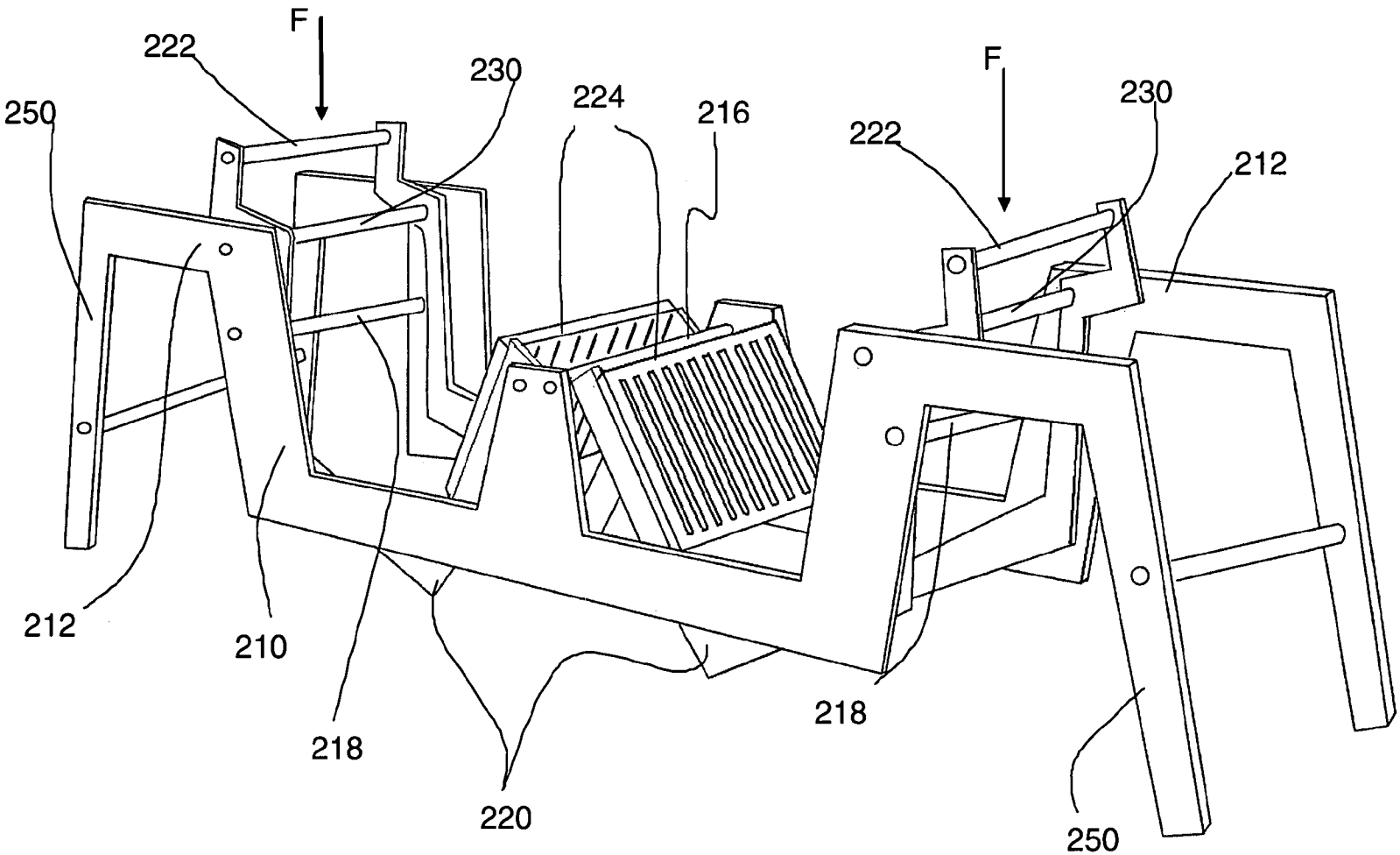
FIG. 7 is a perspective drawing of another embodiment of a loom in accordance with the disclosure, the embodiment having a tandem frame.

Another embodiment provides a tandem frame 210 that is suitable for simultaneous loom operation by two operators, as shown in FIG. 7. A tandem frame 210 may include upper supports 212, with each upper support 212 attaching to a shoulder support 250. Two rotatable members 220 are also provided, with each being rotatably attached to the tandem frame 210 by an axle 230. Each of the rotatable members 220 may include a heddle 224 and a chin bar 222. The tandem frame 210 may also include two cloth beams 218 and two warp beams 216, which may operate to support two separate warps (not shown).

To operate the loom illustrated in FIG. 7, a first operator may mount a loom according to the present embodiment on his shoulders using one set of shoulder supports 250. A second operator may mount the loom on his shoulders using the other set of shoulder supports 250. Each operator may then intermittently provide a force F to the chin bar 222, causing his own heddle 224 to move up and down and allowing him to pass a weft (not shown) through a warp (not shown).

While the above described loom has been depicted as utilizing an operator's chin, the disclosure is not intended to be limited to this particular structure. Therefore, alternatives for applying force F to a bar are intended to be within the scope of this disclosure, including all equivalent body parts that may be suitable for applying such force. For example, a loom may utilize an operator's thumb to provide force to the bar, which may be a thumb bar. In such an example, a wrist support may attach to the upper support of the frame in much the same way as the shoulder support of FIG. 5.

In addition to the bar and chin bar disclosed above, the device of this application may further include other elements for receiving the input force F, such as straps. Furthermore, it is contemplated that additional features of traditional looms may be incorporated with the loom of the present disclosure. Such additional features may include a beater, a back beam configured to support the warp, or a breast beam configured to support the cloth. Additionally, it is contemplated that one or more features of one embodiment may be added to, or substituted for, one or more features of another embodiment. Accordingly, it is within the scope of this disclosure to cover embodiments resulting from substitution and replacement of different features between different embodiments.

The above described embodiments and arrangements are intended only to be exemplary of contemplated mechanisms. Other embodiments will be apparent to those skilled in the art from consideration of the specification and practice of the disclosure herein. It is intended that the specification and examples be considered as exemplary only, with a true scope and spirit of the disclosure being indicated by the following claims.

What is claimed is:

1. A loom, comprising:

a frame configured to hold a warp;

a shoulder support mounted on the frame, the shoulder support configured to support the loom with the shoulders of an operator; and a rotatable member mounted on the frame, the rotatable member including a chin bar;

wherein the rotatable member is configured to rotate in response to a force applied to the chin bar by the chin of an operator; and wherein rotation of the rotatable member is configured to create a shed in the warp.

2. The loom of claim 1, wherein the rotatable member further comprises a heddle.

3. The loom of claim 2, wherein the heddle is detachable.

4. The loom of claim 1, further comprising a body support mounted on the frame, the body support configured to support the loom with the body of an operator.

5. The loom of claim 1, wherein the chin bar is adjustable relative to the rotatable member.

6. The loom of claim 1, wherein the shoulder support is adjustable relative to the frame.

7. The loom of claim 4, wherein the body support is adjustable relative to the frame.

8. The loom of claim 1, further comprising:

a warp beam mounted on the frame; and a cloth beam mounted on the frame.

9. The loom of claim 8, wherein the warp beam is configured to be rotated.

10. The loom of claim 9, further comprising a ratchet configured to engage the warp beam and selectively prevent rotation of the warp beam in at least one direction.

11. The loom of claim 8, wherein the cloth beam is configured to be rotated.

12. The loom of claim 11, further comprising a ratchet configured to engage the warp beam and selectively prevent rotation of the cloth beam in at least one direction.

13. A tandem loom, comprising:

a frame having a first end and a second end, the frame configured to hold a first warp and a second warp;

a first shoulder support attachable to the first end of the frame and configured to be mounted on the shoulders of a first operator;

a second shoulder support attachable to the second end of the frame and configured to be mounted on the shoulders of a second operator;

a first rotatable member attached to the first end of the frame by a first axle, the first rotatable member including a first chin bar and a first heddle;

a second rotatable member attached to the second end of the frame by a second axle, the second rotatable member including a second chin bar and a second heddle;

wherein the first rotatable member is configured to translate a force on the first chin bar from the chin of the first operator into a force on the first heddle, causing the first heddle to create a shed in the first warp; and wherein the second rotatable member is configured to translate a force on the second chin bar from the chin of the second operator into a force on the second heddle, causing the second heddle to create a shed in the second warp.

14. The tandem loom of claim 13, further comprising:

a first warp roller rotatably attached to the frame and configured to hold a first end of the first warp; and a second warp roller rotatably attached to the frame and configured to hold a first end of the second warp.

15. The tandem loom of claim 13, further comprising:

a first cloth roller rotatably attached to the frame and configured to hold a second end of the first warp; and second cloth roller rotatably attached to the frame and configured to hold a second end of the second warp.

16. The tandem loom of claim 14, further comprising:

a first ratchet engageable with the first warp roller, the first ratchet configured to limit rotation of the first warp roller; and a second ratchet engageable with the second warp roller, the second ratchet configured to limit rotation of the second warp roller.

17. The tandem loom of claim 15, further comprising:

a first ratchet engageable with the first cloth roller, the first ratchet configured to selectively prevent rotation of the first cloth roller; and a second ratchet engageable with the second cloth roller, the second rather configured to selectively prevent rotation of the second cloth roller.

18. A method of weaving, comprising:

providing a loom comprising:

a frame having a warp beam and a cloth beam;

a shoulder support mounted on the frame, the shoulder support configured to engage the shoulders of an operator; and a rotatable member mounted on the frame, the rotatable member including a chin bar and a heddle;

winding a warp between the warp beam and the cloth beam, the warp being threaded through the heddle;

mounting the frame onto the shoulders of an operator;

applying a force to the chin bar with the chin of an operator; and creating a shed in the warp.

19. The method of claim 18, further comprising moving the operator's chin to apply a force to the chin bar.

20. The method of claim 19, further comprising:

providing a weft; and passing the weft at least partially through the shed.

* * * * *

UNITED STATES PATENT AND TRADEMARK OFFICE

CERTIFICATE OF CORRECTION

PATENT NO. : 7,658,210 B1
APPLICATION NO. : 12/285768
DATED : February 9, 2010
INVENTOR(S) : Nyce It is certified that error appears in the above-identified patent and that said Letters Patent is hereby corrected as shown below:

Column 7, line 6, "the second rather configured" should read --the second ratchet configured--.

Signed and Sealed this

Twenty-seventh Day of April, 2010

David J. Kappos

David J. Kappos
*Director of the United States Patent and Trademark Office*